US010839996B2

(12) United States Patent
Jenkins, III

(10) Patent No.: US 10,839,996 B2
(45) Date of Patent: Nov. 17, 2020

(54) MULTILAYERED ELECTROMAGNETIC ASSEMBLY

(71) Applicant: Arthur L. Jenkins, III, New York, NY (US)

(72) Inventor: Arthur L. Jenkins, III, New York, NY (US)

( * ) Notice: Subject to any disclaimer, the term of this patent is extended or adjusted under 35 U.S.C. 154(b) by 0 days.

(21) Appl. No.: 16/723,371

(22) Filed: Dec. 20, 2019

(65) Prior Publication Data

US 2020/0126704 A1 Apr. 23, 2020

Related U.S. Application Data

(63) Continuation of application No. 14/652,410, filed as application No. PCT/US2013/075124 on Dec. 13, 2013, now Pat. No. 10,546,677.

(60) Provisional application No. 61/737,750, filed on Dec. 15, 2012.

(51) Int. Cl.

| | |
|---|---|
| ***H01F 27/22*** | (2006.01) |
| ***H01F 5/00*** | (2006.01) |
| *H01F 7/06* | (2006.01) |
| *H01F 27/28* | (2006.01) |

(52) U.S. Cl.

CPC ..... *H01F 5/00* (2013.01); *H01F 27/22* (2013.01); *H01F 2007/062* (2013.01); *H01F 2007/068* (2013.01); *H01F 2027/2809* (2013.01)

(58) Field of Classification Search

CPC .... H01F 5/00; H01F 27/22; H01F 2027/2809; H01F 2007/062; H01F 2007/068; H01F 7/1607

See application file for complete search history.

(56) References Cited

U.S. PATENT DOCUMENTS

| | | | |
|---|---|---|---|
| 3,182,383 | A | 5/1965 | Rosenberg |
| 4,253,079 | A | 2/1981 | Brosh |
| 4,873,757 | A | 10/1989 | Williams |
| 4,987,398 | A | 1/1991 | Bessho |

(Continued)

OTHER PUBLICATIONS

Australian Examination Report, Application No. 2018253549, Completed: Aug. 3, 2019, 6 Pages.

(Continued)

*Primary Examiner* — Tuyen T Nguyen

(74) *Attorney, Agent, or Firm* — Welsh IP Law LLC

(57) ABSTRACT

A multilayered electromagnetic assembly. The assembly has a plurality of substantially planar substrate layers, each substrate layer having a cutaway portion. An insulated electrically conductive material is provided, arranged in a spiral configuration on at least two of the substrate layers. The spiral configuration is formed from adjacent the cutaway portion to the edges of the substrate layer. The electrically conductive material is formed substantially on and/or partially recessed or beneath the surface of the substrate layer. The spiral configurations have first and second electrical contacts that are operable to pass electric current to electrical contacts of spiral configurations on other substrate layers. A ferromagnetic core is located through the cutaway portions of the substrate layers. The substrate layers are stacked and an electrical current is passed sequentially through the two or more spiral configurations, thereby generating a magnetic field in the core.

10 Claims, 3 Drawing Sheets

(56) References Cited

U.S. PATENT DOCUMENTS

| | | | | |
|---|---|---|---|---|
| 5,929,733 | A | 7/1999 | Anzawa et al. | |
| 6,144,281 | A | 11/2000 | Lorris | |
| 9,595,379 | B2 * | 3/2017 | Yeo | H01F 27/02 |
| 10,147,531 | B2 * | 12/2018 | Rai | H01F 27/22 |
| 2002/0070834 | A1 | 6/2002 | Dadafshar | |
| 2004/0070481 | A1 | 4/2004 | Patel et al. | |
| 2005/0242916 | A1 | 11/2005 | So | |
| 2007/0103808 | A1 | 5/2007 | Kiyono et al. | |
| 2008/0079524 | A1 * | 4/2008 | Suzuki | H01F 27/2804 336/61 |
| 2009/0041994 | A1 | 2/2009 | Ockenfuss et al. | |
| 2009/0085706 | A1 | 4/2009 | Baarman et al. | |
| 2010/0259351 | A1 | 10/2010 | Bogert et al. | |
| 2010/0321146 | A1 | 12/2010 | Zhang et al. | |
| 2011/0025067 | A1 | 2/2011 | Cipriani | |
| 2012/0105178 | A1 | 5/2012 | Niimi | |

OTHER PUBLICATIONS

U.S. Office Action, U.S. Appl. No. 14/652,410, dated Mar. 23, 2016, 14 Pages.

* cited by examiner

MULTILAYERED ELECTROMAGNETIC ASSEMBLY

BACKGROUND OF THE INVENTION

This invention relates to an electromagnetic assembly constructed of multiple, stacked layers, and to integrated heat mitigation techniques. The invention is especially suited to the assembly of micro-electromagnets and micro-solenoids.

SUMMARY OF THE INVENTION

According to a first aspect of the invention there is provided a multilayered electromagnetic assembly, the electromagnetic assembly comprising:

a plurality of substantially planar substrate layers, each substrate layer having a cutaway portion;

an insulated electrically conductive material arranged in a spiral configuration on at least two of the substrate layers, the spiral configuration formed from adjacent the cutaway portion to the edges of the substrate layer, the electrically conductive material being formed substantially on and/or partially recessed or beneath the surface of the substrate layer, the spiral configurations having first and second electrical contacts that are operable to pass electric current to electrical contacts of spiral configurations on other substrate layers; and a ferromagnetic core, located through the cutaway portions of the substrate layers;

wherein the substrate layers may be stacked and an electrical current may be passed sequentially through the two or more spiral configurations, thereby generating a magnetic field in the core.

The ferromagnetic core may be fixed relative to the assembly, thereby functioning as an electromagnet, or moveable within the assembly, thereby functioning as a solenoid.

Typically, the cutaway portions, the core and the spiral configurations are substantially circular in plan view; although these may all be formed of other applicable shapes and geometric patterns.

The electromagnetic assembly may be modular and expandable, or manufactured in an integrated form.

According to a second aspect of the invention there is provided a multilayered electromagnetic assembly, the electromagnetic assembly comprising:

a plurality of substantially planar substrate layers, each substrate layer having a cutaway portion;

one or more heat conducting layers substantially dedicated to heat conduction, being provided on one or more portions of one or more of the said planar substrate layers and/or being distinct planar layers;

an insulated electrically conductive material arranged in a spiral configuration on at least two of the substrate layers, the spiral configuration formed from adjacent the cutaway portion to the edges of the substrate layer, the electrically conductive material being formed substantially on and/or partially recessed or beneath the surface of the substrate layer, the spiral configurations having first and second electrical contacts that are operable to pass electric current to electrical contacts of spiral configurations on other substrate layers; and a ferromagnetic core, located through the cutaway portions of the substrate and heat conducting layers;

wherein the substrate layers may be stacked and an electrical current may be passed sequentially through the two or more coils, thereby generating a magnetic field in the core, with any internal heat generated within the electromagnetic assembly being conducted through the one or more heat conducting layers and out to at least one external surface.

The ferromagnetic core may be fixed relative to the assembly, thereby functioning as an electromagnet, or moveable within the assembly, thereby functioning as a solenoid.

Preferably, the substrate layers further comprise at least one heat conducting portion provided thereon at a position common to some or all of the other substrate layers, the heat conducting portion passing through the substrate to provide a conducting surface on both sides of the layer, thereby enabling heat passing through the heat conducting layers to pass through the overlapping common heat conducting portions provided on each substrate layer.

Separate connections are consequently provided between layers for the electrical conduction and for the heat conduction, so that the electrical current always flows in a particular spiral orientation around the ferromagnetic core through the electrical contacts and heat generated may flow from within the assembly to radiating external surfaces on the outside of the assembly through the separate heat conducting portion pass through system.

DETAILED DESCRIPTION

The illustrations are intended to provide a general understanding of the concepts described and the structure of various embodiments, and they are not intended to serve as a complete description of all the elements and features of methods and systems that might make use of the structures or concepts described herein. Many other embodiments will be apparent to those of skill in the art upon reviewing the description. Other embodiments may be utilized and derived therefrom, such that structural and logical substitutions and changes may be made without departing from the scope of this disclosure. It should also be appreciated that the figures are merely representational, and are not be drawn to scale and certain proportions thereof may be exaggerated, while others may be minimized. Accordingly, the specification and drawings, together with any examples, are to be regarded in an illustrative rather than a restrictive sense and the specific form and arrangement of the features shown and described are not to be understood or interpreted as limiting on the invention.

Figure 1:
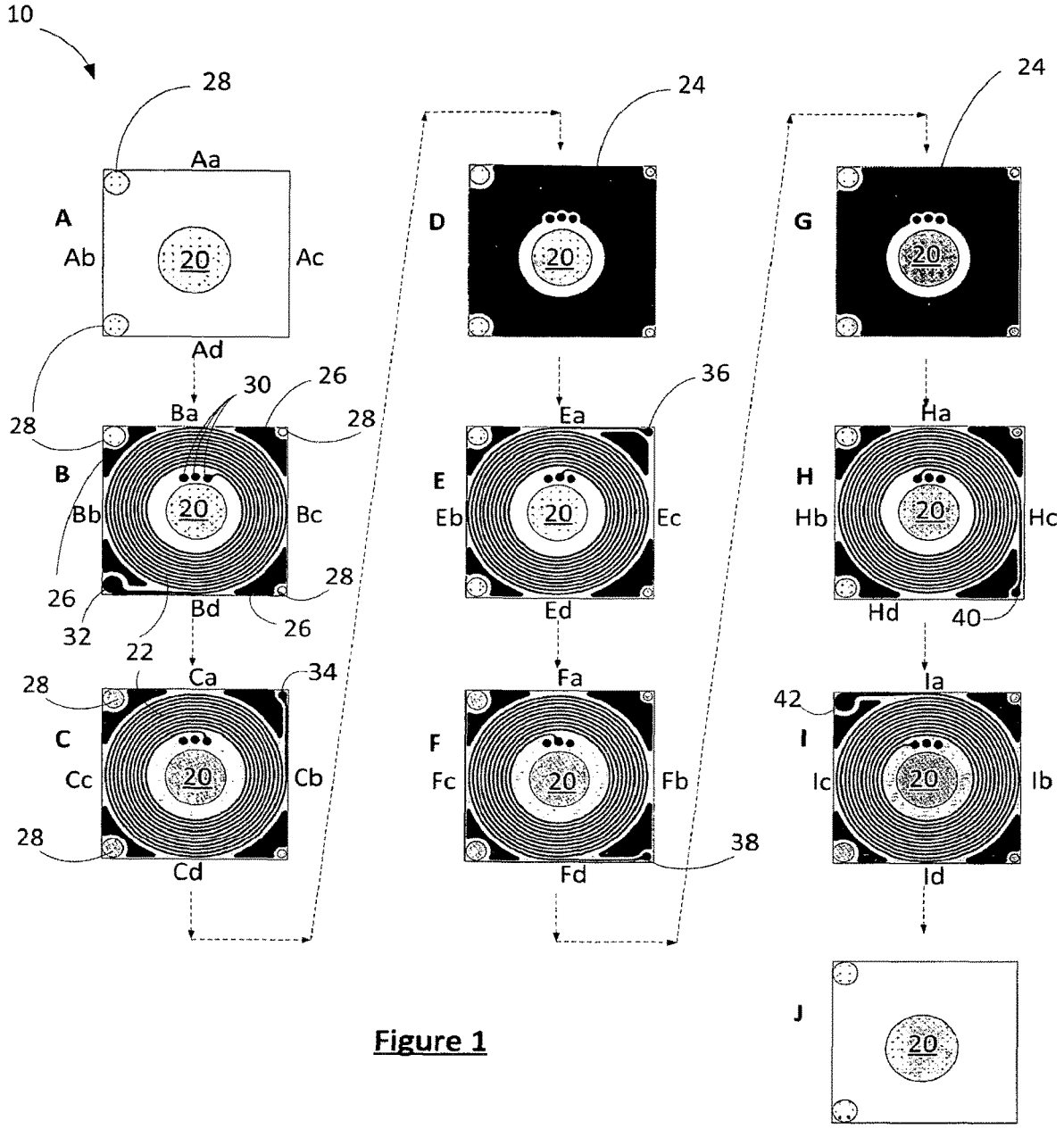
FIG. 1 shows stackable layers that in combination comprise the electromagnetic assembly of the present invention.
Figure 2:
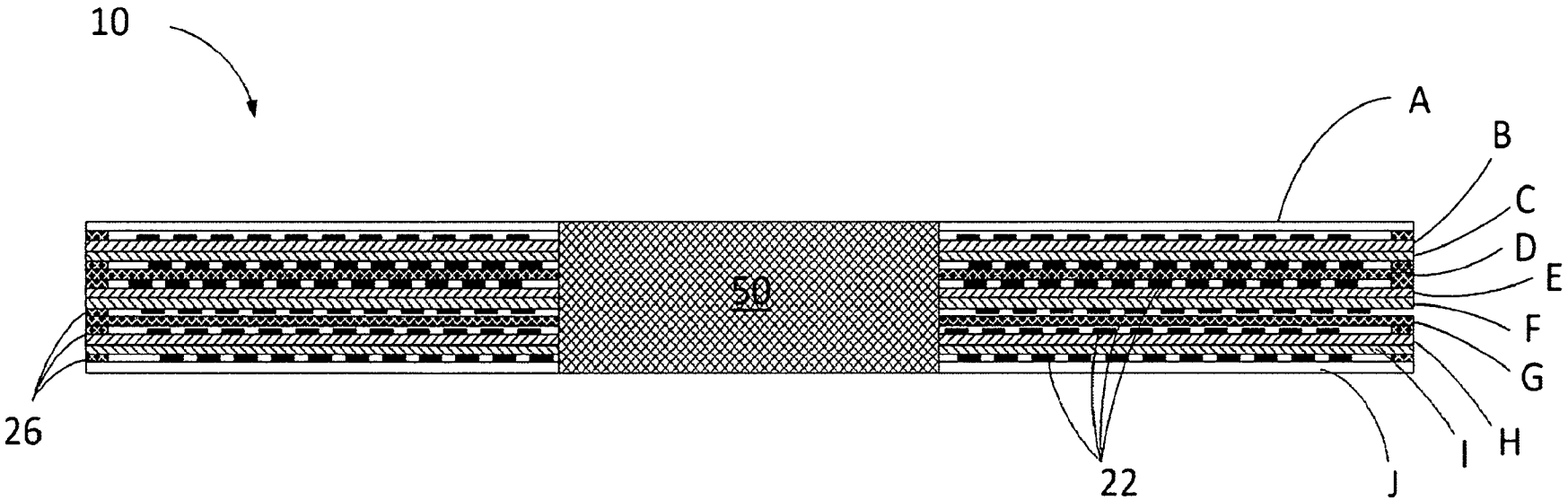
FIG. 2 shows a side view of the electromagnetic assembly of FIG. 1.
Figure 3:
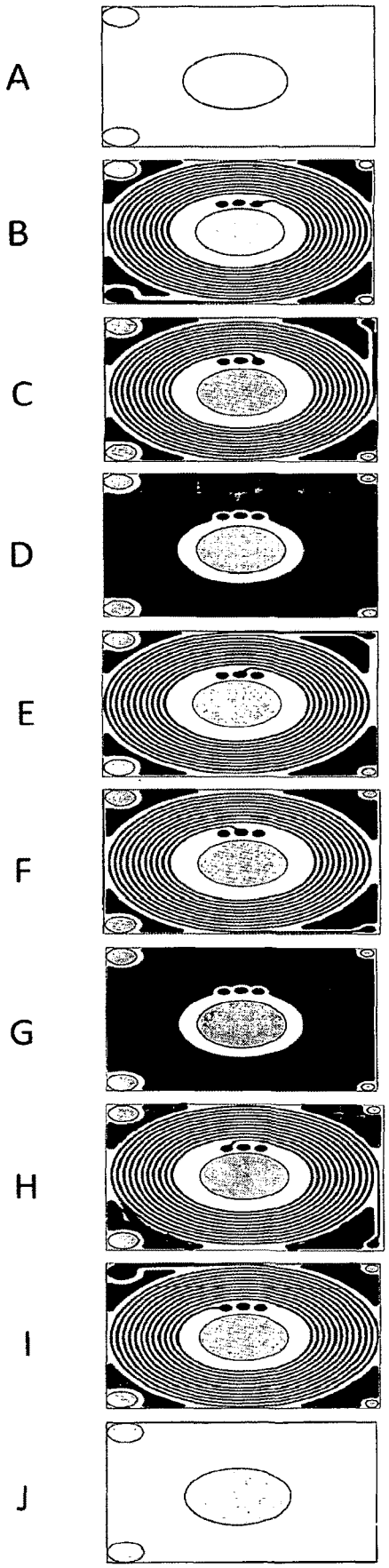
FIG. 3 shows an exploded view of an example of one iteration of a full set of the layers of the electromagnetic assembly of FIGS. 1 and 2.

FIGS. 1 to 3 show multiple layers that may be stacked, one on top of the other, to form an electromagnetic assembly 10. The electromagnetic assembly described herein is a miniaturized micro-electromagnet; although the principles are not limited to such small devices and clearly also have application and utility for larger electromagnetic assemblies.

In the figures, layer A is the top cover and layer J is the bottom cover. All of the layers A-J have a cutaway portion 20, through which a ferromagnetic core is positioned when all of the layers are stacked and assembled. The cutaway portion is typically 1-2 mm in diameter, but may be smaller or larger as appropriate. The primary layers providing the electromagnetic attributes of the electromagnet assembly are substantially planar substrate layers B, C, E, F, H and I; these substrate layers carry a spiral of insulated conductive material 22 (typically copper) formed in a substantially flat configuration between the outer edges of the substrate layers and the inner cutaway portion provided for the core, thereby forming a flattened radiating coil on the layer substrate. In the electromagnetic assembly shown, heat conducting layers 24 are also provided between certain substrate layers.

The layers are illustrated in a substantially square configuration, although it should be appreciated that any appropriate shape could be used, such as substantially circular, hexagonal, octagonal shapes or other entirely regular or irregular shapes. Equally, the spiral of conductive material 22 need not be substantially circular, and could be formed in triangular, square, hexagonal, octagonal or other cross-sectional patterns as appropriate. The substrate layers B, C, E, F, H and I are typically manufactured from silicon, polyester, polyimide, or some other similar substance upon which modern computer etching techniques can be used to imprint the spiral of conductive material 22. For example, the substrate laminate could be DuPont AP 9111 with AP9110 copper-clad polyimide film, with a cover insulation of DuPont LF0110 Acrylic adhesive on polyimide film. These layers also have heat conducting portions 26 provided at the corners of the layers and enveloping the holes 28 of the respective layers. The heat conducting portions shown are shaped in the illustrated manner simply to take advantage of the surface area available for this purpose. In addition to the holes provided at the corners of the substrate layers, small holes 30 are provided at key positions to enable connection of conductive material between the layers.

Although etching is described, other applicable means of securing or imprinting the spiraling conductive material 22 and/or the heat conducting portions 26. Such means may include laser or other techniques.

The assembled configuration of the electromagnetic assembly 10 is as follows (for the purposes this description, each layer has arbitrarily been designated with "a" for the top edge, "d" for the lower edge, and "b" and "c" for the side edges; with "b" being on the left and "c" on the right when looking in plan perspective at the etched surface of any substrate layer):

The top cover A is located above substrate layer B (and layers C-J lie sequentially beneath these layers). The positive anode is arbitrarily located through the hole 28 at the Ab/Ad corner, connecting the metallic connector 32 of the spiral formed on substrate layer B. The conductive material of the spiral is etched to run at a particular thickness (for example, 1 oz. copper is typically 0.0036 mm thick) spiraling counter-clockwise around a successively smaller radius so that the spiral comes as close to the prior adjacent conductor as can still be safely insulated, and spirals in to a point just outside the cutaway portion 20 where it connects with the Bc side small hole 30. The substrate layer C (shown transparently to indicate the surface is on the other side) is positioned downwards (the etched surfaces of layers B and C being back-to-back relative to one another). As such, the Bc connecting small hole 30 and the Cb small hole 30 are aligned and in communication and the spirals formed on their relative surfaces are connected.

On the surface of substrate layer C, starting at the applicable small hole 30, the spiral forms outwardly to a metallic connector 34 at the corner Ca/Cb, which is connected through to the metallic connector 36 of layer E (passing through layer D which will be described in more detail below). When looking at the etched surface of layer C the spiral runs clockwise, but as it has been turned over, when viewed from above in plan perspective, the spirals of both layers B and C run counter-clockwise, and as such the magnetic forces that will be generated by each layer on application of electric current around the core will not be in conflict. Put differently, application of the right-hand rule principle demonstrates the forces adding to each other, and not interfering.

The spiral 22 on layer E is formed counter-clockwise inwardly to the central small hole 30, where it is connected through the associated small hole to the clockwise spiral on layer F (which like layer C has the etched surface pointing down). The spiral on layer F flows clockwise outwardly to the metallic connector 38, which in turn is connected to the metallic connector 40 on layer H. The spiral on layer H is formed counter-clockwise inwardly to the central small hole 30, where it is connected through the associated small hole to the clockwise spiral on layer I (which like layers C and F has the etched surface pointing down). The spiral on layer I flows clockwise outwardly to the metallic connector 42. The cathode is connected through the hole 28 of the bottom cover J to the metallic connector 42 on layer I.

The ferromagnetic (magnetically active substance) core 50 is then positioned within the cylindrical cavity formed within the cutaway portions of the layers A-J and a current source can be applied to the cathode and anode. It should be evident that the stacked configuration of the spiral layers creates an effective coil around the core. Ferromagnetic substances include iron, Supermendur™, NuMetal™, Supermalloy™, and others. It should also be evident that the ferromagnetic core may be fixed relative to the assembly, thereby functioning as an electromagnet, or moveable within the assembly, thereby functioning as a solenoid.

In the illustrative example, three layers of spiral pairs have been provided, but this could be extended to many more pairs, or reduced to less pairs. Indeed, application of electrical current through the conductive spiral of a single etched substrate layer around a core will generate magnetic forces. In addition, the example described has back-to-back substrate layers carrying spirals to form pairs, but single substrate layers could be double-sided and have a spiral etched on both sides.

From FIGS. 1 and 2, it can be seen that two heat conducting layers 24 (D and G, typically made from copper) are interposed between the substrate layer pairs. The purpose of these heat conducting layers is to enable heat generated within the electromagnetic assembly 10 to move to the outside of the device. Heat generation is a significant problem in micro-electronic devices, as heat can become trapped within the insulation of the spiral conductive material and/or the substrate. For example, tests on an electromagnet formed of two spiral pairs resulted in temperatures of 117° F., 125° F. and 170° F. using 2V, 2.5V and 3V respectively; any of which will compromise functionality, or damage or destroy the device. Rather than attempting to cool the electromagnetic assembly externally, the heat conducting layers are inserted in an integrated manner to mitigate this heating, by directing the heat away from the surfaces of the substrate layers carrying spiraling conductors outwardly to the edges. The heat conducting layers are also in contact with the heat conducting portions 26 provided on the substrate layer corners. These heat conducting portions are positioned at locations common to some or all the other substrate layers and each heat conducting portion passes through the substrate providing a conducting surface on both sides of the layer; thereby enabling heat to pass through adjacent, common, contacting heat conducting portions and moving the heat from the edges to the top and bottom of the electromagnetic assembly where heat is more efficiently radiated away from the assembly.

In this manner a low-profile electromagnetic assembly is possible, either in a modular (expandable) or integrally manufactured device, which is capable of generating maximal magnetic fields without overheating and without cooling as such.

At this point in time, design specifics are somewhat limited by modern production methods, but as progressive miniaturization of devices and products continues, the potential for further reduced sizing is envisaged. For the purposes of illustration, where the substrate layer is 1 cm square and the central cutaway portion 20 for the core 50 is 1 mm in diameter, then that would allow for a spiral with an outer radius of just under 5 mm and an inner radius of just over 0.5 mm. With a spiral thickness of 0.0036 mm of conductor (1 oz. copper) and 0.0014 of insulation, this gives a turn thickness of 0.0050 mm. This would allow 900 turns around the core per spiral layer; or 9,000 turns total for a magnet of 5 spiral pairs.

The height of a 10 layer (three spiral pair substrate layer pairs, two heat conducting layers and two covers) electromagnet is less than 1 mm from top to bottom.

Different design ratios of size of the square layer, size of the hole, type of conductor material, size of conductor etched "wiring", and distance between layers can be imagined, as can different types of spirals (square, triangular, other geometric shaped designs depending on the needs of the design and final shape desired) can be constructed as well, as well as different locations and techniques for placing the cathode and anode connections or layer-to-layer connections.

What is claimed is:

1. An electromagnetic assembly, comprising:

a bottom substrate having an opening and a conductive trace surrounding the opening, the conductive trace disposed relative to a bottom portion of the bottom substrate;

a top substrate having an opening and a conductive trace surrounding the opening, the conductive trace disposed relative to a top portion of the top substrate;

a stack between the bottom substrate and the top substrate, the stack including:

a lower substrate having an opening and a conductive trace surrounding the opening, the conductive trace disposed relative to a top portion of the lower substrate;

an upper substrate having an opening and a conductive trace surrounding the opening, the conductive trace disposed relative to a bottom portion of the upper substrate; and a heat conductor between the lower substrate and the upper substrate, the heat conductor having an opening;

wherein the respective openings of the bottom substrate, the top substrate, and the lower and upper substrates of the stack are aligned relative to one another such that they collectively form a cavity for receiving a ferromagnetic core.

2. The electromagnetic assembly of claim 1, wherein the respective conductive traces of the bottom substrate, the top substrate, and the lower and upper substrates of the stack are electrically connected to form a conductive path.

3. The electromagnetic assembly of claim 1, wherein the respective conductive traces of the bottom substrate, the top substrate, and the lower and upper substrates of the stack each define a spiral pattern.

4. The electromagnetic assembly of claim 1, wherein the bottom substrate, the top substrate, and the lower and upper substrates of the stack are each planar.

5. The electromagnetic assembly of claim 1, wherein the respective conductive traces of the bottom substrate, the top substrate, and the lower and upper substrates of the stack each have a first end adjacent their respective openings and a second end adjacent an outer edge of the respective substrate.

6. The electromagnetic assembly of claim 1, further comprising a ferromagnetic core fixed within the cavity.

7. The electromagnetic assembly of claim 1, further comprising a ferromagnetic core movable within the cavity.

8. The electromagnetic assembly of claim 1, wherein the bottom substrate is integrally formed with the lower substrate of the stack.

9. The electromagnetic assembly of claim 1, wherein the top substrate is integrally formed with the upper substrate of the stack.

10. The electromagnetic assembly of claim 1, wherein the stack is a first stack, and the electromagnetic assembly further includes a second stack substantially identical to the first stack, the second stack positioned between the first stack and the top substrate.

* * * * *